United States Patent [19]

Humphrey

[11] Patent Number: 4,502,692

[45] Date of Patent: Mar. 5, 1985

[54] ARCHERY ARROW HAVING PLASTIC VANES

[76] Inventor: Stanley A. Humphrey, 3212 Third Avenue South, Minneapolis, Minn. 55408

[21] Appl. No.: 639,732

[22] Filed: Aug. 13, 1984

[51] Int. Cl.[3] ..... F41B 5/02

[52] U.S. Cl. ..... 273/423; 273/420

[58] Field of Search ..... 273/423, 420

[56] References Cited

U.S. PATENT DOCUMENTS

| | | | |
|---|---|---|---|
| 2,193,397 | 3/1940 | Dykes | 273/423 |
| 3,106,400 | 10/1963 | Zwickey | 273/423 |
| 3,815,916 | 6/1974 | Meszaros | 273/423 |
| 4,392,654 | 7/1983 | Carella | 273/423 |

*Primary Examiner*—Paul E. Shapiro

*Attorney, Agent, or Firm*—Clayton R. Johnson

[57] ABSTRACT

An archery arrow having a plurality of vanes mounted on the rear part of the arrow shaft and that each includes an axially elongated first edge portion that includes a first edge and is adhered to the shaft with its axial intermediate part extending arcuately through a greater angle than its front part and of a shorter axial length than its front part, and an axially elongated second terminal edge that intersects the first edge at axial front and rear points. Angularly between the first edge portion front and rear parts the vane forwardly diverges relative to the shaft from the intermediate part at a small acute angle. With reference to the shaft central axis the vane is transversely arcutately curved so that as viewed from the front of the arrow the vane extends angularly through about 145° to 180° angle relative to the central axis when three vanes are mounted on the shaft.

19 Claims, 10 Drawing Figures

ARCHERY ARROW HAVING PLASTIC VANES

BACKGROUND OF THE INVENTION

An archery arrow that includes an arrow shaft and a plurality of collapsible vanes mounted on the shaft adjacent its butt end.

In U.S. Pat. No. 4,392,654 to Carella there is disclosed a flexible vane having a continuously curved portion that throughout its axial length is substantially spaced from the shaft and is inclined in a rearward direction to converge toward the shaft. The foot of each vane is aligned longitudinally with the shaft, or mounted to extend angularly or helically. In U.S. Pat. No. 4,003,576 to Carella the arrow includes a pair of vanes with one disposed to extend downwardly relative to the shaft and the other upwardly, a pair of vane supports that may be spiralled or disposed helically and an arcuate base portion that extends about 180° about the shaft, joined to the adjacent edges of the vane supports and adhered to the shaft.

In my U.S. patent application, Ser. No. 507,055, filed June 23, 1983, now U.S. Pat. No. 4,488,728, there is disclosed an archery arrow wherein each vane has axially elongated terminal edge portions with one edge portion secured to the shaft and the other to the shaft and/or the one edge portion, a leg joined to each edge portion to extend outwardly from the shaft and a looped portion extending between and joined to the legs to open toward the shaft. U.S. Pat. No. 3,595,579 to Benoit discloses three vanes having flaps secured to the arrow shaft, the pair of flaps for each vane subtending an angle of about 120°.

In order to provide a vane having a relatively small profile and having good collapsing qualities when coming in contact with a solid object and good flight stability qualities this invention has been made.

SUMMARY OF THE INVENTION

An arrow shaft having a plurality of axially elongated vanes mounted thereon wherein each vane has a first terminal edge portion extending the length thereof and joined to the shaft with an axial intermediate part extending angularly relative to the shaft through a greater angle than the front axial part which is of a greater axial length than the intermediate part. The vane is transversely arcuately curved to in axial planes containing the central axis of the shaft diverge in a forward direction from the central axis at small acute angles for at least the major part of the transverse width and axial length of the vane.

One of the objects of this invention is to provide new and novel means for an arrow that has a relatively small profile and good flight stability. Another object of this invention is to provide for an archery arrow a vane of a new and novel contour that has good collapsing qualities when contacting a solid object in flight and yet be relatively rigid. In furtherance of the last mentioned object it is another object of this invention to provide a vane of a contour that has good rotational qualities and thereby better flight stability.

BRIEF DESCRIPTION OF THE DRAWINGS

FIG. 1 is a plane view of the archery arrow of this invention with a major part of the shaft between the arrow point and a vane broken away;

FIG. 2 is a fragmentary side view showing the vanes when the shaft is rotated 90° from the position shown in FIG. 1;

FIGS. 3, 5, 6 and 7 are cross sectional enlarged cross sectional views generally taken along the line and looking in the direction of the arrows 3—3, 5—5, 6—6 and 7—7 respectively of FIG. 2;

Figure 7:
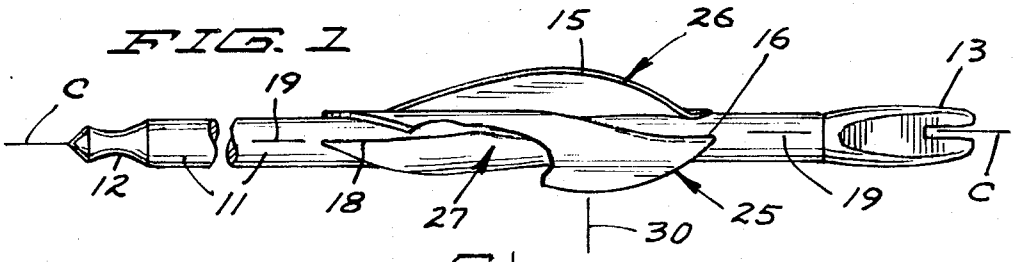

Referring to the drawings the invention includes an axially elongated cylindrical arrow shaft 11 that at its front end mounts an arrow head 12 and at its butt end mounts a noch 13. The parts 11, 12 and 13 may be made as separate members of different materials or as a unitary single member.

A plurality of vanes 25, 26, 27 are symetrically mounted on the shaft butt end portion, each vane being made of the same material and the same size and shape. Advantageously there are provided three vanes.

Each of the vanes is made of a piece of plastic or plastic cloth material that is semi-rigid. That is each vane is of sufficient flexibility that it can collapse to extend at least partially around the shaft with the maximum radial spacing of a part of the vane remote from the shaft being substantially less than the maximum radial spacing of said part when the vane is in its datum shape. The vane material has a memory so that after the force acting against the vane to collapse it is removed, the vane returns to its datum shape shown in FIGS. 1-3 and 5-7. The vanes are of sufficient rigidity to substantially remain in their datum shapes when the arrow is in flight and will maintain its datum shape when the vane is not in contact with a solid object other than the arrow shaft to which it is attached.

Figure 4:
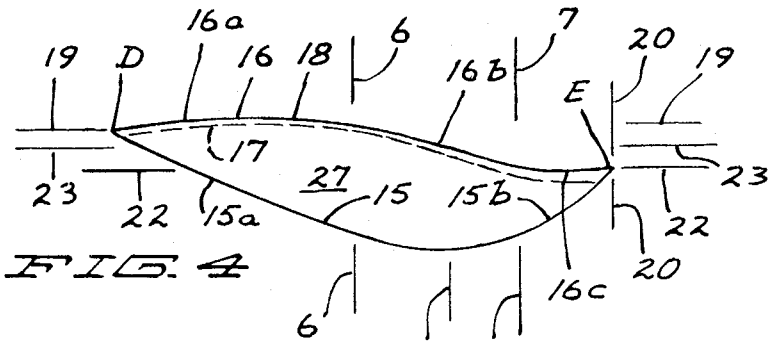
FIG. 4 is a plan view of one of the vanes in a flat condition before being secured to the shaft.
Figure 10:
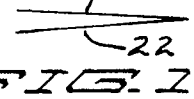
FIGS. 9 and 10 are to illustrate the angle of general forward divergence of one of the vanes from the shaft in the axial planes 23—23 and 22—22 respectively.

Each vane is axially elongated and includes opposite edges 15, 16 that intersect at their front ends at a point D and at their rear ends at point E. One edge portion 18 along the length thereof between edge 16 and dotted line 17 is adhesively adhered to the shaft, edge portion 18 being the only part of the vane adhered to the shaft. Considering the vane as secured to the shaft, the transverse spacing of edges 15, 16 along the surface thereof progressively increases in a rearward direction from point D to a location closely adjacent to line 6—6 (transverse plane that is the same as that of the cross section of FIG. 6) of FIGS. 2 and 4; and likewise progressively increases in a forward direction from point E to a location closely adjacent line 6—6. It is noted as used herein a transverse plane refers to a plane perpendicular to the central axis.

For purposes of describing the invention the line on one side of the shaft that an axial plane 19—19 containing the central axis of the shaft intersects the shaft peripheral surface and passes through point D will be considered as a reference line or plane 19—19. The axial spacing of point D from plane 6—6 is substantially the same as the axial spacing of plane 6—6 from line (transverse plane) 20—20 that contains point E.

Edge 16 has a front part **16*a*** that is arcuately curved in an axial direction about relatively large radii of curvature to have a bowed portion opening toward line 19—19 on one angular side thereof such that the area of the front part of the vane on said one side of the line is very small to that on the opposite side. The front part extends axially from point D to line 6—6. The axial intermediate part 16*b* of line 16 extends in an axial rearward direction from line 6—6 to line (transverse plane) 7—7. The axially intermediate part 16*b* is continuously curved along the length thereof to extend through an angle of at least about 90°, advantageously an angle of about 110° to 130°, and preferrably about 120° when three vanes are used. The axial spacing of line 7—7 from line 6—6 is about 30% to 35% of the axial length of the vane (axial distance from point D to plane 20—20). From planee 7—7 to point E which is of an axial length of about 15% to 20% of the total axial length of the vane, the rear part 16*c* of edge 16 extends straight or nearly straight (slightly bowed to open toward line 19—19) in an axial direction. As may be noted in FIG. 4 the rear part of edge portion 18 in a rearward axial direction from adjacent line 7—7 is of an increasing angular dimension to its intersection with edge 15 at a location near point E. Thus the edge portion 18 of the vane adhered to the shaft and edge 16 along the lengths thereof in an axial rearward direction for a substantial part (forward part 16*a*) of its axial length extend nearly entirely axially relative the shaft (at most very little in a transverse angular direction) while intermediate part 16*b* extends through a substantial arcuate angle relative to the shaft, and the front part 16*a*, and the rear part 16*c*, of edge 16 extends through a small angle that is many times smaller than the arcuate angle of extension of part 16*b*. The maximum transverse arcuate spacing of edge 15 from line 19—19 is at the intersection of line 30 with edge 15 and is axially about midway between planes 6—6 and 7—7.

Even though the width of edge portion 18 increases at the rear part of the vane, the rear part of edge portion 18 throughout its length extends arcuately through an angle that is much smaller than the arcuate angle of extension of the intermediate part of edge portion 18, for example about 15°-25° maximum, in the direction of the arrow 31 from the juncture of edge parts 16*b*, 16*c*. Further the rear part of edge portion 18 in an axial rearward direction extends transversely further in the direction of arrow 31 than the rear end of the intermediate part of portion 18 while the intermediate part in a rearward direction extends arcuately further in a direction of arrow 31 than the front part of portion 18. The arcuate dimension of edge portion 18 from just rearwardly of point D to adjacent line 7—7 is relatively small, for example an arcuate angle of about 3°-5°, while line 17 is of increasing arcuate spacing from rear part 16*c* in a rearward direction so that the maximum width of the rear part of portion 18 is axially intermediate point E and plane 7—7 but closer to point E.

Edge 15 has an edge part 15*a* that extends from point D to about line 6—6, or slightly axially rearwardly of line 6—6, and when the vane is flat extends linearly at an acute angle relative to line 19—19, for example about 15°-20°. Edge 15 also has a rear part 15*b* that extends from the rear terminal end of edge part 15*a* and is arcuately curved in an axial rearward dirction to initially extend progressively more remote from line 19—19 through a minor part of the axial length thereof and thereafter progressively more closely adjacent to line 19—19 to intersect point E.

Figure 9:
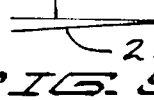
Figure 8:
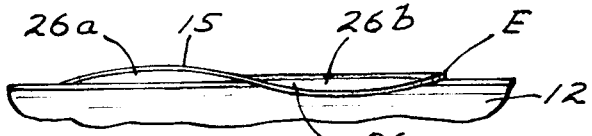
Figure 9:
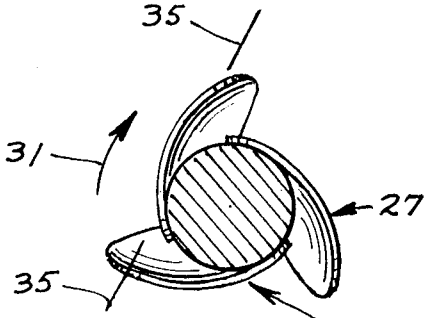

In an axial plane 23—23 containing the central axis C—C and intersecting edge part 16*b* along a line angularly about midway from line 19—19 and the juncture of edge part 16*b* to edge part 16*c* the angle of the line of intersection of said plane with the surface of the shaft, indicated by line 22 in FIG. 9 relative the line of intersection with the vane, indicated by line 28 (which may be slightly axially arcuately curved to open toward the shaft) is at a very small acute angle, for example about 1°-2° that opens in a forward axial direction. In an axial plane 22—22 containing the central axis C—C and intersecting edge part 16*b* at its juncture with part 16*c*, the angle of the line of intersection 22 of this plane with the surface of the shaft relative to the line of intersection with the vane, indicated by line 29 (which may be slightly axially arcuately curved to open toward the shaft) is at a small acute angle, for example about 3°-5°, that opens in a forward axial direction.

As may be noted from the drawings each vane in part is in overlapping radial spaced relationship to a radial adjacent part of the adjacent vane that is located angularly in the direction of arrow 31. For example axial plane 19—19 passes through parts of two vanes on the same side of the shaft (same side of the central axis). Further the maximum transverse spacing (distance) of edge 15 from edge 16 along the surface of the vane is the same or less than twice the diameter of the shaft while the maximum radial spacing of the vane from the shaft is less than the diameter of the shaft.

The vane is transversely arcuately curved so that, with the exception of at least part of the rear end portion, it will cross a plane 36—36 (see FIG. 3) throughout a substantial part of the axial length of the vane two times wherein the plane is tangential to the shaft in transverse angular spaced relationship to at least the forward part of edge portion 18 in the direction of arrow 31, but not sufficiently angularly spaced from part 16*a* that the tangential plane fails to intersect the vane angularly between the line of tangency and adjacent the maximum transverse spacing of edge 15 along the surface of the vane from line 19—19. The axial length of the lines of the intersection of the vane with such a tangential plane and the transverse angular spaceing of the line of intersection depends on the transverse angular spacing of the line of tangency of the plane to the shaft from edge part 16*a*. Thus if the tangential plane contained the line 23—23 on the surface of the shaft, the length of the lines of intersection would be approximately half the axial length of the vane.

Additionally as viewed from the front, the vane is transversely arcuately curved to extend angularly relative the central axis of the shaft through an angle of about 145° to 180° when three vanes are used. It is noted that each vane does not extend angularly through such an angle in any one transverse plane.

Figure 8:
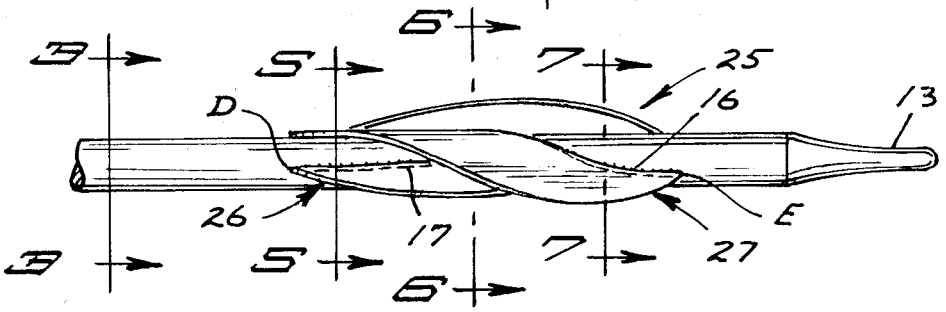
FIG. 8 is a fragmentary side view showing one of the vanes when the shaft is rotated to a position that the rear point of the vane is substantially directly vertically above the shaft central axis.
Figure 7:
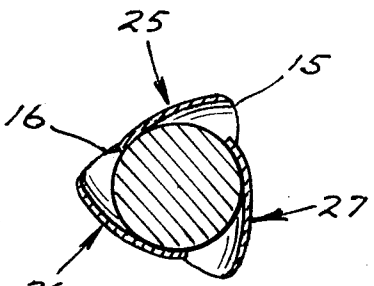
Figure 6:
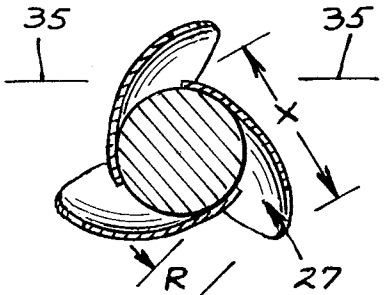
Figure 5:
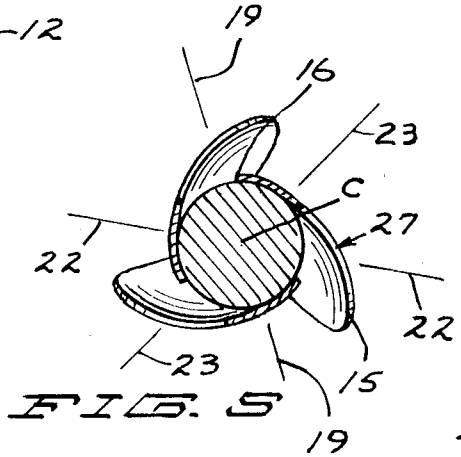

When the shaft is rotated to the FIG. 8 position where point E of the vane is substantially directly vertically above the central axis there can be seen the front part of the surface 26*a* facing the shaft and the rear part of the opposite surface 26*b* of the then top vane as viewed from the side. The part of the edge 15 that can be seen, in a rearward direction, initially extends to progressively higher elevations relative to and above the shaft, then to progressively lower elevations and thence to higher elevation to at its rear end extend above the shaft a distance equal to the thickness of the vane. As viewed in FIG. 8, the forwardmost part of edge 15 can not be seen, the forward part that can be seen extending to a maximum elevation that is above the elevation of the top of the shaft by a distance that is of a dimension about 10% to 20% of the diameter of the shaft while the rearward part extends to a minimum elevation that is below the elevation of the top of the shaft by a distance that is of a diameter of about 10%-20% of the diameter of the shaft. Also as seen in FIG. 8 the axial length of the part of the edge that extends above the shaft is about the same as that seen below the top of the shaft while the part axially between the opposite ends of that which can be seen is at the same elevation as the top of the shaft is adjacent the intersection of line 30 with edge 15.

Each vane from point D to point E is smoothly transversely arcuately curved in the direction of arrow 31 from its juncture to the shaft to edge 15 to open away from a plane 35—35 tangential to to the intersection of plane 19—19 with the surface of the vane opposite the shaft. The perpendicular spacing of the vane from the tangential plane increases in the direction of arrow 31 from the line of tangency through at least a major part of the axial length of the shaft.

Further in an axial rearward direction to at least about plane 7—7 the transverse curvature of the vane from the edge portion 18 to about line 22 is such that the maximum radial spacing of the vane from the shaft central axis is only slightly greater than the radius of the shaft, but thereafter increases relatively rapidly in the direction of arrow 31 to a maximum axially adjacent to the point that the line 30 intersects edge 15 where the radial spacing may be, for example, about 1.5 to 3 times the radius of the shaft. As view in transverse cross section the angular spacing of point D in the direction of arrow 31 from the intersection of line 30 with edge 15 may be, for example about 145°-180°.

As already indicated, each vane from angularly in the direction of the arrow 31, the front part of edge portion 18 (part that is in part defined by edge part 16*a* and extends the axial length thereof to line (plane) 22 in a forward axial direction is inclined to be of increasing radial distances from axis C—C. Each vane in corresponding axial planes angularly in the direction of arrow 31 from plane 22 to an axial plane containing the intersection of line 30 with edge 15 diverge from the central axis in a forward direction from a location at least as far rearwardly as plane 7—7 (i.e. at least the major portion of the length of the vane) at angles that are greater than the angles of divergence in plane 22. Preferrably the maximum angle of such divergence, which would be adjacent to the intersection of line 30 with edge 15 is less than about 10°. Even though it has been at least inferred, the intersection of the axial planes with the vane is along a straight line, such a line may be slightly curved along the length thereof; however the degree of curvature is not sufficient to be visiably noticed with the naked eye.

The fron and rear ends of edge portion 18 may be slightly rounded.

For at least a major part of the axial length and transverse width of the vane of this invention, the vane extends predominently transversely angularly relative to the shaft in a radial outward direction from its juncture to the shaft in contrast to that of the vane such as disclosed in my copending application and the above mentioned patents wherein the major parts of the vane that extend radially outwardly from its juncture with the shaft extend predominently radially outwardly in an angular direction. That is in any transverse plane from just rearwardly of where line 17 intersects edge 15 to about plane 7—7, the transverse arcuate dimension of the vane is greater than the maximum radial spacing R from the shaft and the linear (minimum) transverse spacing X of edge 15 from line 17 is greater than the maximum radial spacing from the shaft (see FIG. 6). The vane is smoothly continuously transversely arcutely curved from one transverse edge to the other throughout at the major part of its length, this being in contrast to two vane parts intersecting at a single visibly noticeable apex point or line such as a fold line, or in the direction of extension (other than axially opposite ends) abruptly changing directions at a visibly noticeably given point or line. Thus the vane of this invention is of a contour requiring less profile than convention vanes which results in less drag and a greater velocity. At the same time more flight stability is obtained due to more effecient rotational properties gained throught the vanes decreased radial outward extensions relative to its maximum transverse extension from the juncture of the vanes to the shaft.

Additionally due to the less profile, when shooting in the woods, there is a smaller change of hitting branches or leaves while obtaining good flight stability. Also due to the vane being arcuately curved to extend through a relatively large angle relative the central axis, including the part thereof not adhered to the shaft, while extending at a maximum a relatively short distance radially outwardly from the shaft, the vane readily collapses when striking a solid object in flight while imparting better rotation properties to the shaft to yield good flight stability even when replaceable blade type broadheads are mounted on the shaft.

What is claimed is:

1. An arrow that includes an axially elongated arrow shaft having a central axis, a peripheral surface, a front end and a rear end, and a plurality of axially elongated vanes mounted on the shaft adjacent the shaft rear end, each vane being of a semi-rigid material and having an axially elongated first edge portion secured to the shaft that includes an axially elongated first terminal edge and an axially elongated second edge that throughout at least a major part of its axial length is transversely spaced from the first edge, said first edge portion including an axially elongated front part, an axially elongated intermediate part and a rear part, said intermediate part along the length thereof extending along the peripheral surface through a greater angle than the front part along its length and extending angularly rearwardly different from the angular extent of the front part along the length thereof.

2. The arrow of claim 1 further characterized in that each vane in transverse cross sections for at least a major part of its axial length is of a smooth arcuate curvature in one angular direction relative to the central axis from the first edge portion to the second edge.

3. The arrow of claim 1 further characterized in that each vane is inclined relative to the shaft to diverge therefrom in a forward direction at a small acute angle in an axial plane containing the central axis and intersecting the intermediate edge portion in angular spaced relationship to the front edge portion.

4. The arrow of claim 1 further characterized in that each vane in part is in radial alignment with another vane on the same side of the shaft and radially spaced from said another vane.

5. The arrow of claim 4 further characterized in that the maximum transverse dimension of each vane along the surface thereof is less than twice the diameter of the shaft.

6. The arrow of claim 5 further characterized in that the second edge is a terminal edge that throughout a major part of its axial length extends predominently in an axial direction.

7. The arrow of claim 6 further characterized in that the second edge along at least a major portion of the length of the vane is radially spaced from the shaft.

8. The arrow of claim 7 further characterized in that the first and second edges intersect at an axially front point and an axial rear point and are continuously smoothly curved along the length thereof.

9. An arrow that includes an axially elongated arrow shaft having a central axis, a peripheral surface, a front end, a rear end, and a plurality of axially elongated vanes mounted on the shaft adjacent the shaft rear end, each vane being of a semi-rigid material and having an axially elongated first edge portion joined to the shaft that includes an axially elongated first terminal edge and an axially elongated second terminal edge that at least along a major portion of its length is transversely spaced from the first edge portion and radially spaced from the shaft, the first edge portion having an axial front part, an intermediate part, and a rear part, each vane being relatively smoothly arcuately curved in transverse cross section throughout a major portion of its length to extend transversely and radially away from the central axis and continuously extend more remote from the transversely aligned part of the first edge, each vane being transversely arcuately curved to intersect in two angular spaced locations, a plane tangential to the peripheral surface angularly intermediate the first edge portion front part and a part of the second edge.

10. The arrow of claim 9 further characterized in that the intermediate part extends circumferentially relative the peripheral surface through a greater angle than the front part, the front part being of a greater axial length than the intermediat part.

11. The arrow of claim 10 further characterized in that the rear part is transversely angular offset from the front part and that the vane in an axial plane containing the central axis and angularly between the front and rear parts diverges from the peripheral surface in an axial forward direction from the intersection of the last mentioned plane with the intermediate part.

12. The arrow of claim 9 further characterized in that there are provided at least three vanes and that the intermediate part of each vane extends circumferentially through an arcuate angle of at least about 90°.

13. The arrow of claim 9 further characterized in that the intermediate part extends arcuately through a greater angle than each of the front and rear parts, that the front, intermediate and rear parts are of axial lengths of about 50%, 35% to 30%, and 15% to 20% respectively of the axial length of the vane, that the vane second edge intersects axial planes containing the central axis angularly between the front and rear parts at increasing radial spacing from the central axis in a transverse direction away from the first part and that the maximum transverse dimension of the first edge from the second edge along the surface of the vane is less than twice the diameter of the shaft.

14. The arrow of claim 9 furthe characterized in that the vane has a surface opposite the shaft and that the vane is transarcuately curved along a major portion of the axial length of the vane to open axially away from a plane tangential to said surface that is radially aligned with at least a portion of said first part.

15. The arrow of claim 14 further characterized in that the arcuate curvature along the major portion of the length of the vane is such that the perpendicular spacing of the vane from the tangential plane substantially continuously increases in an angular direction away from the first edge toward the second edge rearwardly of the front end of the first edge.

16. The arrow of claim 15 further characterized in that in transverse planes from just rearwardly of the juncture of the vane to the shaft to rearwardly adjacent the juncture of the intermediate and front parts the transverse linear spacing of the second edge from the juncture of the vane to the shaft is greater than the maximum radial spacing of the vane from the shaft.

17. An arrow that includes an axially elongated arrow shaft having a central axis, a peripheral surface, a front end, a rear end, and a plurality of axially elongated vanes mounted on the shaft adjacent the shaft rear end, each vane being of a semi-rigid material and having an axially elongated first edge portion joined to the shaft that includes an axially elongated first terminal edge and an axially elongated second terminal edge that at least along a major portion of its length is transversely spaced from the first edge portion and radially spaced from the shaft, the first edge portion having an axial front part, an intermediate part, and a rear part, each vane being relatively smoothly arcuately curved in transverse cross section throughout a major portion of its length to extend transversely and radially away from the central axis, and each vane in transverse planes axially from just rearwardly of the front end of the vane to adjacent the juncture of the intermediate and front parts, the transverse linear spacing of the second edge from the juncture of the vane to the shaft is greater than the maximum radial spacing of the vane from the shaft throughout a major part of the axial length of the vane.

18. The arrow of claim 17 further characterized in that in axial planes intersecting the first edge portion intermediate part and containing the central axis the vane diverges in a forward direction from the intermediate part at a small acute angle.

19. The arrow of claim 17 further characterized in that as viewed from the front the vane is arcuately curved to extend through an angle of about 145°–180° relative the central axis.

* * * * *